United States Patent [19]

Dunkers

[11] 4,298,471

[45] Nov. 3, 1981

[54] APPARATUS FOR EQUALIZATION OF OVERFLOW WATER AND URBAN RUNOFF IN RECEIVING BODIES OF WATER

[76] Inventor: Karl R. Dunkers, Hästskovägen 7, S-183 50 Täby, Sweden

[21] Appl. No.: 185,684

[22] Filed: Sep. 10, 1980

Related U.S. Application Data

[63] Continuation of Ser. No. 10,929, Feb. 9, 1979, abandoned.

[30] Foreign Application Priority Data

Mar. 2, 1978 [SE] Sweden ..... 7802392

[51] Int. Cl.[3] ..... C02F 1/00; E02B 13/00

[52] U.S. Cl. ..... 210/170; 210/242.1; 210/320; 405/52

[58] Field of Search ..... 210/170, 242.1, 515, 210/518, 525, 320; 137/236 R, DIG. 21; 405/60, 107, 52

[56] References Cited

U.S. PATENT DOCUMENTS

| | | | |
|---|---|---|---|
| 3,635,347 | 1/1972 | Rupnick | 210/242.3 |
| 3,674,687 | 7/1972 | Quase | 210/170 X |
| 3,701,428 | 10/1972 | Losh | 210/170 |
| 3,771,662 | 11/1973 | Muramatsu et al. | 210/242.3 |
| 3,788,481 | 1/1974 | de Angelis | 210/242.3 |
| 3,833,122 | 9/1974 | Cook | 210/207 |
| 3,923,649 | 12/1975 | Sparham et al. | 210/242.1 |
| 3,988,241 | 10/1976 | Rafael | 210/242.1 X |
| 4,008,155 | 2/1977 | Castell | 210/242.1 |
| 4,117,683 | 10/1978 | Rasmussen | 405/52 X |
| 4,225,434 | 9/1980 | Ernst et al. | 210/170 X |

FOREIGN PATENT DOCUMENTS

| | | |
|---|---|---|
| 221874 | 5/1910 | Fed. Rep. of Germany . |
| 1960602 | 6/1971 | Fed. Rep. of Germany . |
| 336988 | 7/1971 | Sweden . |
| 338952 | 9/1971 | Sweden . |
| 155954 | 11/1973 | Sweden . |
| 14950 | 2/1976 | Sweden . |

*Primary Examiner*—Robert H. Spitzer
*Attorney, Agent, or Firm*—Stevens, Davis, Miller & Mosher

[57] ABSTRACT

An apparatus for equalization of overflow water and urban runoff in receiving bodies of water is disclosed. A tank separated from the body of water is arranged so that the tank volume or parts thereof are alternatingly filled by polluted water and by water from said body of water. This tank is formed by generally vertical walls extending from the surface of the body of water to its bottom and is divided into a series of compartments by means of similar intermediate walls. The compartments are in communication in sequence through apertures in the intermediate walls. A first compartment communicates with an inlet for polluted water, and a last compartment communicates with the body of water surrounding the tank.

4 Claims, 4 Drawing Figures

APPARATUS FOR EQUALIZATION OF OVERFLOW WATER AND URBAN RUNOFF IN RECEIVING BODIES OF WATER

This is a Continuation of application Ser. No. 010,929 filed Feb. 9, 1979 (now abandoned).

The present invention relates to the treatment of polluted water and more specifically to apparatus for equalization of overflow water and urban runoff in a lake or other receiving body of water.

In handling overflow and urban runoff or stormwater it is essential that suitable arrangements are made for equalizing variations in incoming flows. Equalization of peak flows during rainy weather makes it possible to carry out treatment of the water in a purposeful fashion using suitable methods, e.g. chemical precipitation of filtering.

Balancing tanks in different forms have been usually used for the equalization function. The most usual tank types are concrete basins, earth dams and dikes in lake areas. Common to all these types is that the effective net volume for storage is dependent on the difference in level between the highest water level, often the overflow level at the same time, and the lowest water level, i.e. the level where the pumps are automatically switched off.

When planning equalization tanks, the greatest possible level difference is striven for, which can be obtained with regard to the other technical premises. The level conditions of the feed pipes and the associated risk of water rise in these pipes is the upward limiting factor, however. Downwardly, on the other hand, the limit is set by the building economy requirement of keeping the tank bottom above ground water level. The result of these considerations is that the difference in levels is comparatively small in practice, usually only a meter or so.

In order to provide useful tank volumes, the insufficient difference in levels must therefore be compensated by relatively large tank areas. This leads in turn to practical difficulties in placing the tanks, especially in and in the vicinity of dwelling areas, i.e. where stormwater treatment is most urgent from the point of view of water protection.

Characteristic for these tank types is that dimensioning of the walls is determined by large pressure differences: earth pressure and/or water pressure on the outside and an empty tank on the inside. This naturally results in heavy and expensive tank structures.

The object of the present invention is to circumvent these difficulties by making an equalizing tank of a completely new type where, thanks to utilizing the principle of gradual displacement, practically the whole of the tank volume can be utilized without dependence on vertical level differences, the pressure differences between the inside and outside of the tank walls being reduced to insignificant values.

The apparatus according to the invention essentially comprises a series of compartments arranged in a receiving body of water such as a lake, each compartment being formed by walls placed in the lake substantially from its surface to its bottom, these compartments being in communication with each other in sequence, the first compartment in the series being connected to an inlet for overflow water or urban runoff, and the last compartment in communication with the surrounding water in the lake, as is more closely disclosed in claim 1.

The first compartment in the series in which the feed water comes in is suitably made so that it can serve as a separation area for oil and scum, and has a pump for taking water from it to a treatment plant, from which the treated water is led to the receiving body of water outside the equalization tank.

It is known per se to arrange sedimentation tanks as tanks floating in a body of water. A sedimentation tank constantly has a flow-through in one direction of a single medium, i.e. the polluted water, which is supplied at one end and departs at the other, sedimentable material being deposited during flow through the tank. On the other hand, in an equalization tank according to the invention there are two media, namely the fed-in overflow water or urban runoff, which fills the portion of the tank nearest the inlet, and water from the receiving body of water which fills the remainder of the tank volume, the boundary between these media varying in accordance with prevailing conditions, primarily the amount of overflow water or urban runoff coming in, as will be described in detail in the following.

The invention will now be described in conjunction with the accompanying drawings.

Figure 1:
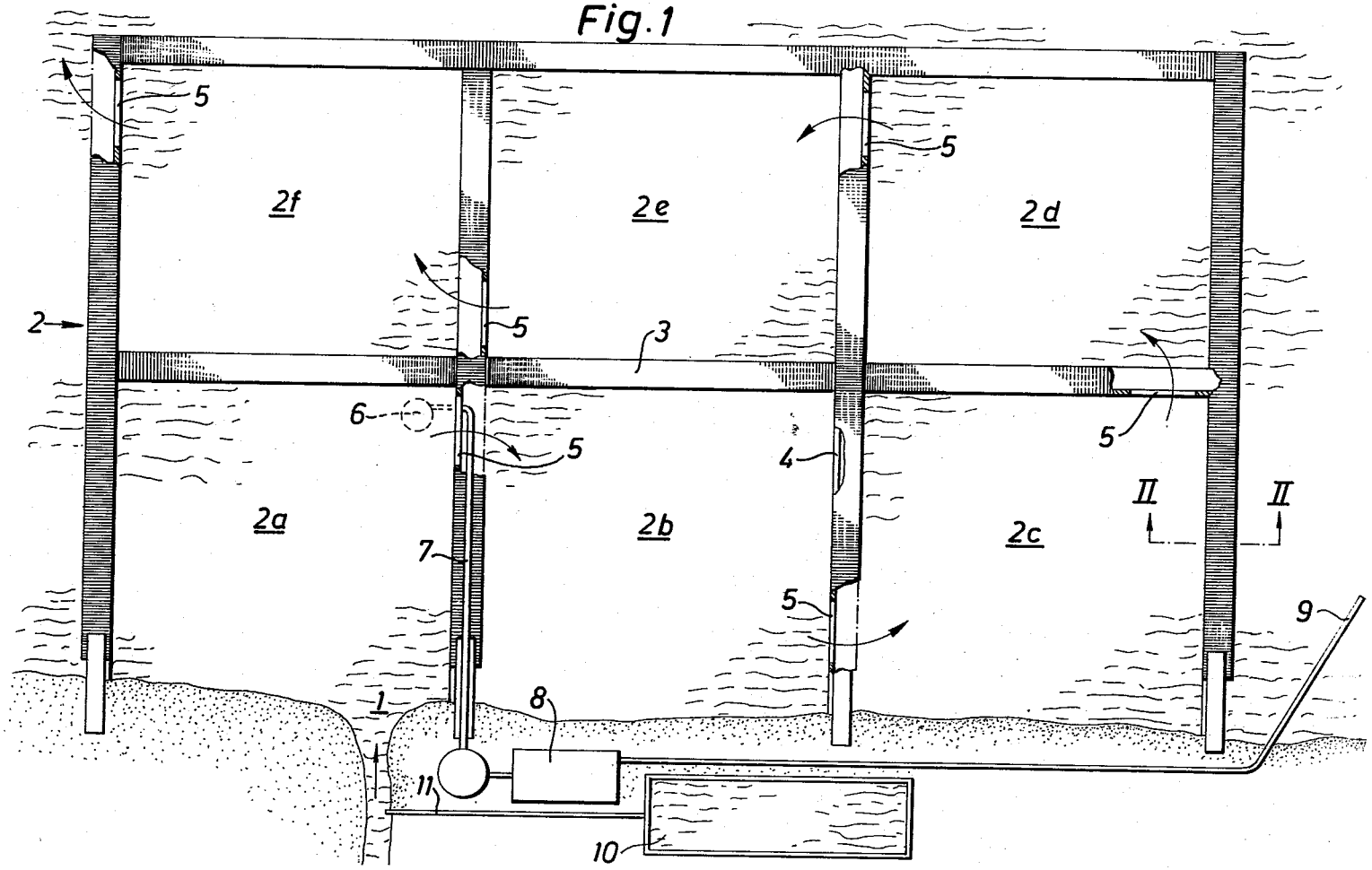
FIG. 1 shows schematically in plan view a plant according to the invention.

In FIG. 1 there is shown a floating tank 2 separated into compartments 2*a*–2*f* and arranged in a lake, polluted water being led to the tank via an overflow water and/or urban run-off inlet 1. The outer walls and the intermediate walls defining the compartments of the tank 2 are made from flexible wall material such as plastic sheeting 4, hanging down from pontoons 3, laid out in the water and anchored in a way not shown.

Figure 2:
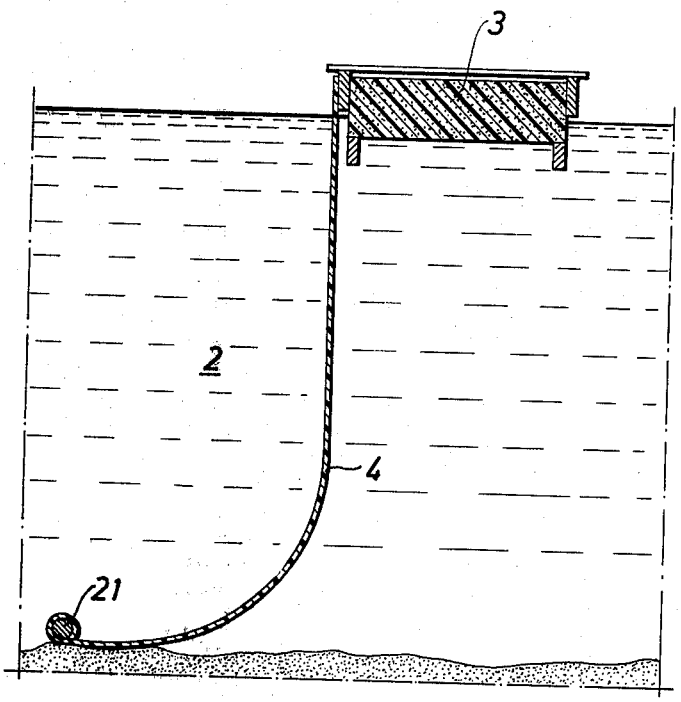
FIG. 2 is a vertical section along the line II—II in FIG. 1.
Figure 3:
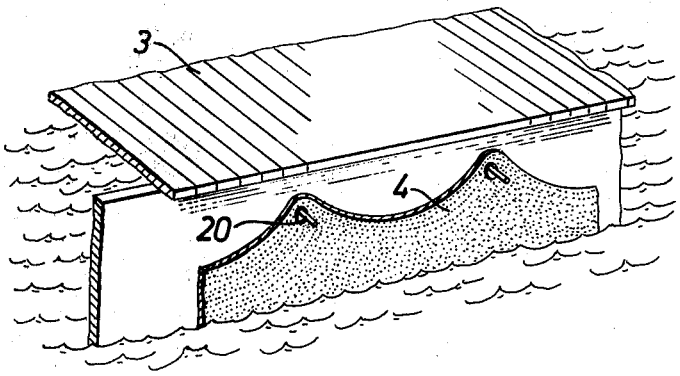
FIG. 3 is a perspective view showing a detail.

The plastic sheeting 4 can be arranged as is shown in detail in FIGS. 2 and 3. The sheeting is attached along its upper edge to the pontoons 3, e.g. by suspensions from spikes 20 or by being nailed onto the pontoons, while at its bottom edge it is provided with weights 21 keeping it in contact with the bottom. The height of the sheeting should be sufficiently great to take up prevailing variations in water level. It should be pointed out here that the function does not require any great degree of leakproofing, either between the tank walls and bottom or between the different parts of the tank walls, since minor leakage is unimportant.

The compartment 2*a* is arranged opposite the inlet 1, so that the water is fed into this compartment. The compartments 2*a*–2*f* are in communication in the order given, by means of apertures 5 in the intermediate walls separating them. These apertures are suitably placed alternatingly upward and downwards, and also diagonally opposite each other. Thus, in the example shown, the aperture 5 between the compartments 2*a* and 2*b* is placed downwards (close to the bottom of the lake) similar to the openings between the compartments 2*c* and 2*d* and between the compartments 2*e* and 2*f*, while the apertures between the compartments 2*b* and 2*c* and between the compartments 2*d* and 2*e* are arranged upwards (at the water surface). Similarly, the aperture 5 between the compartment 2*f* and the surrounding water is arranged upwardly. By such an arrangement of the openings, a uniform turnover of the tank content is facilitated, and simultaneously stratification of the lake water and urban runoff occurring during differences in water temperature is counteracted.

The aperture in the first compartment 2*a* is, as mentioned, situated at the bottom, resulting in that this compartment functions as a closed separation space for oil and scum. An immersible pump 6 is placed in this compartment, and via a pressure pipe 7 it supplies a treatment plant 8 at constant flow. The treated water is taken from the treatment plant via a discharge pipe 9 to the receiving body of water.

The sludge separated in the treatment plant should normally be pumped into a wastewater pipe for further transport to a municipal treatment plant. If this is not possible, the urban runoff treatment plant is equipped with its own sludge drying beds 10, alternatively with mechanized sludge dewatering, and associated drainage pipe 11 for the sludge liquor.

During rainy weather, incoming water exceeds the amount of water which is continuously pumped to the treatment plant. A majority of the incoming water thus bypasses the pump and flows into the next compartment. During a rain period of extended duration, the excess water continues to flow through the compartments. In dimensioning the installations, a certain amount of "overflow" of storm water through the last compartment to the receiving body of water is allowed for some of the greatest rain intensities expected to occur during the course of a year.

When stormwater or urban runoff flows through the series of compartments during rainy weather, there is a gradual mixing with and displacement of the existing tank content, i.e. the lake water. The mixing process between the stormwater and lake water can be understood so that the content in ore of the compartments at a certain time consists of equal parts of stormwater and lake water. Each compartment in the direction of the first compartment contains an increasingly large proportion of stormwater, while each compartment in the direction of the last one contains increasingly large proportions of lake water. The compartment with equal ratios of stormwater and lake water can consequently be regarded as a defined boundary zone for the displacement sequence at said time.

During dry weather there is a displacement in the opposite direction. The quantity of water pumped to the treatment plant is then greater than the incoming stormwater, and the lake water displaces the stormwater in compartment after compartment, the boundary zone being gradually displaced towards the first compartment until the pump begins to convey lake water to the treatment plant.

Expediently, the tank volume is dimensioned so that the entire content of the tank will be filled with lake water during a period of 5–8 days of uninterrupted dry weather. For each rain period occurring subsequently, the gross volume of the whole tank is consequently available for storage.

In lakes with a decided eutrophic character, any reduction of nutrient salt amounts is of importance, whether it is done by stormwater treatment, lake water treatment, or both simultaneously. During the period when there is heavy organic growth in lakes, the greater portion of the circulating nutrient salt quantity is present in the cell tissues of the algae, which means that lake water treatment during these periods can appear more desirable than urban runoff treatment, considering the whole picture. The described treatment system can therefore be operated either for treating storm/lake water or solely lake water by means of relatively simple shunting arrangements.

Different treatment methods can naturally be considered with regard to the function of the treatment plant. If the goal is, however an extensive treatment with considerable reduction of suspended substances, nutrient salts, organic substance and bacteria, chemical precipitation would be the primary preference. The previously described operational mode with constant and continuous delivery from the equalization installation also simplifies the running of a chemical precipitation installation.

According to the example, the floating tank is arranged quadratically in six compartments. Depending on local conditions such as shoreline, shore vegetation, depth of water etc., the tank form can be arranged freely, with the compartments arranged rectangularly in a line, T-shaped, in a half circle etc. The main thing is that the compartments can be joined together to form an unbroken flow series according to the displacement principle described above.

Figure 4:
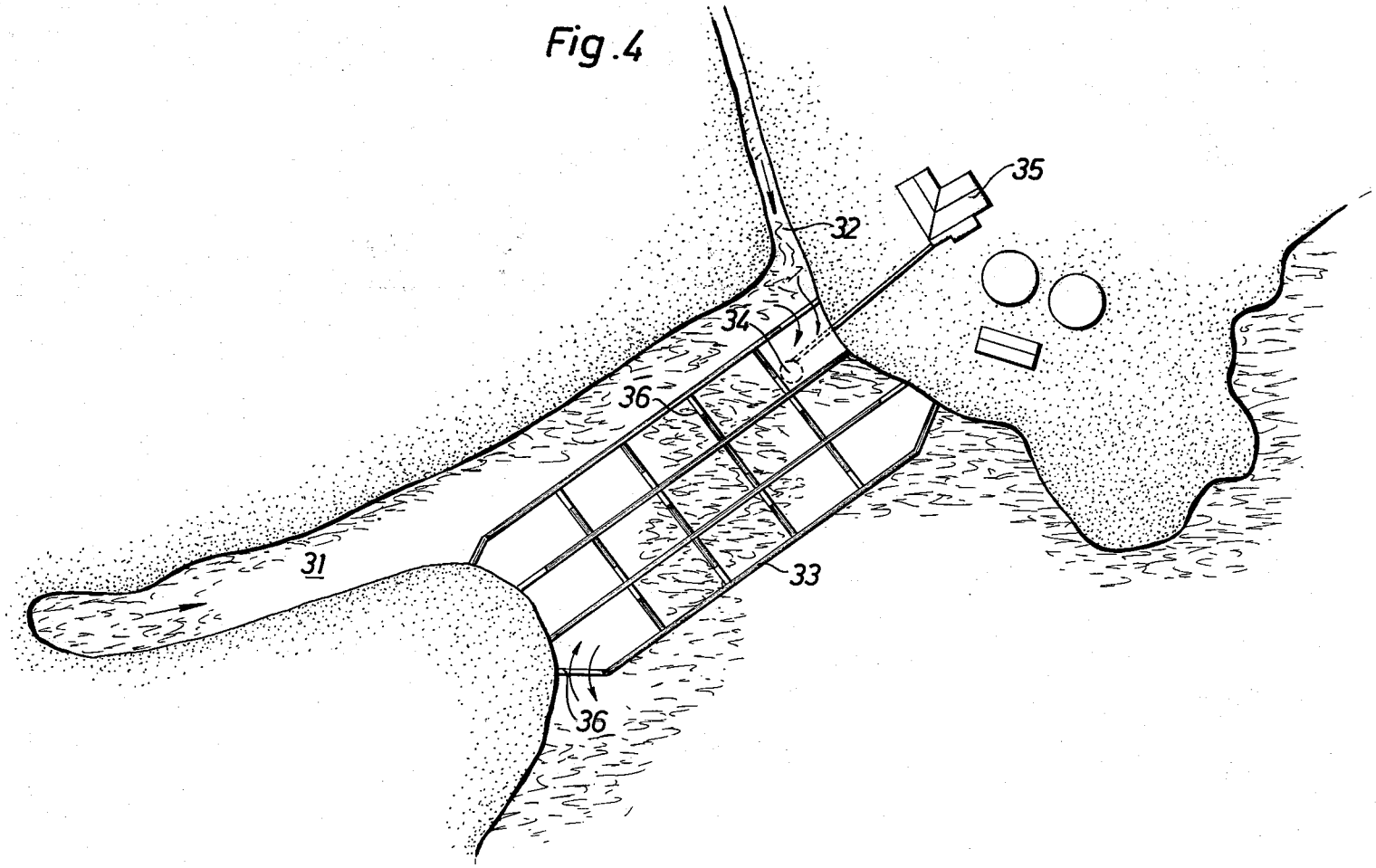
FIG. 4 is a schematic plan view of another embodiment of a plant according to the invention.

FIG. 4 shows another example of an installation in accordance with the invention. In this case there are two inlets 31, 32 for overflow water and/or urban runoff. The tank 33, constructed in principle in the same fashion as the first example, has been placed across a creek, into which both inlets run, such that both streams come into the first compartment, which is provided with a pump 34, as in the previous case, for taking water to a treatment plant 35. The compartments are in common communication in series, as is apparent from the indicated apertures 36, which should be arranged alternatingly upwards and downwards, although this is not shown. The example illustrates the great possibilities of suiting the installation to existing conditions, as in the shown example, inter alia by connecting two or more urban runoff inlets for common treatment.

I claim:

1. An apparatus for equalizing the flow of polluted water comprising a tank including a plurality of sequentially fluid connected compartments arranged in a body of water, a first compartment of said plurality being in communication with an inlet discharging polluted water at a variable rate of flow, and a last compartment of said plurality being in fluid communication with said body of water surrounding said tank such that water may flow either from said last compartment to said surrounding body of water or from said surrounding body of water into said last compartment, said tank being formed with generally vertical outer and intermediate walls, extending from the surface of said body of water to its bottom, which divide said tank into said plurality of compartments, said plurality of compartments being sequentially fluid connected by apertures provided in said intermediate walls and permitting fluid flow in both directions, a pump provided in said first compartment adjacent to the inlet for polluted water and connected to an outlet conduit for withdrawing water from said first compartment at a substantially constant rate of flow, whereby when the rate of discharge of said polluted water into said first compartment exceeds the rate of withdrawal of water by said pump, polluted water will sequentially displace water present in said compartments in a direction toward said surrounding body of water, while when the rate of discharge of polluted water into said first compartment is lower than the rate of withdrawal of water by said pump, water from said surrounding body of water will enter said last compartment and sequentially displace polluted water in the opposite direction toward said first compartment.

2. An apparatus as in claim 1, wherein said tank is open at its top and bottom.

3. Apparatus as claimed in claim 1, characterized in that the apertures between the compartments are arranged alternatingly upwards and downwards, the aperture between the first and the second compartment being arranged downwardly.

4. Apparatus as claimed in any one of claims 1 or 3, characterized in that the walls are formed from flexible material such as plastic sheeting, suspended from pontoons.

* * * * *